US006860038B1

(12) United States Patent
Stucke

(10) Patent No.: US 6,860,038 B1
(45) Date of Patent: Mar. 1, 2005

(54) ATHLETIC SHOE PROTECTION SYSTEM

(76) Inventor: Matthew R. Stucke, 415 N. 15th St., Apt. 1, Bismarck, ND (US) 58501

( * ) Notice: Subject to any disclaimer, the term of this patent is extended or adjusted under 35 U.S.C. 154(b) by 0 days.

(21) Appl. No.: 10/629,140

(22) Filed: Jul. 29, 2003

(51) Int. Cl.[7] ..... A43B 5/18
(52) U.S. Cl. ..... 36/135
(58) Field of Search ..... 36/135, 127, 88, 36/93, 153, 154; 12/142 P, 146 B

(56) References Cited

U.S. PATENT DOCUMENTS

| | | | | | |
|---|---|---|---|---|---|
| 1,340,356 | A | | 5/1920 | Yarnell et al. | |
| 2,076,316 | A | * | 4/1937 | Beals, Jr. | 36/7.5 |
| 3,283,424 | A | | 11/1966 | Struntz | 36/7.5 |
| 3,821,858 | A | | 7/1974 | Haselden | 36/2.5 |
| 3,913,243 | A | * | 10/1975 | Arnold et al. | 36/135 |
| 4,055,005 | A | | 10/1977 | Meinhart | 36/135 |
| 4,693,019 | A | | 9/1987 | Kim | 36/7.3 |
| 5,027,461 | A | | 7/1991 | Cumberland | 12/142 |
| D326,949 | S | | 6/1992 | Beckley | D2/277 |
| 5,305,536 | A | | 4/1994 | Depping | 36/135 |
| 5,367,794 | A | | 11/1994 | Adelstein et al. | 36/135 |
| 5,398,429 | A | | 3/1995 | Olsen | 36/135 |
| 5,555,584 | A | * | 9/1996 | Moore et al. | 12/142 N |
| 5,600,902 | A | * | 2/1997 | Yavitz | 36/135 |
| 5,632,057 | A | * | 5/1997 | Lyden | 12/146 B |
| 5,666,746 | A | | 9/1997 | Pollard | 36/135 |
| 5,722,189 | A | * | 3/1998 | Johnson | 36/135 |
| 5,829,171 | A | * | 11/1998 | Weber et al. | 36/93 |
| 5,960,568 | A | | 10/1999 | Bell et al. | 36/134 |
| 6,195,917 | B1 | * | 3/2001 | Dieckhaus | 36/44 |

* cited by examiner

*Primary Examiner*—Ted Kavanaugh

(57) ABSTRACT

An athletic shoe protection system for effectively protecting the cleats and spikes of athletic shoes while worn by an athlete. The athletic shoe protection system includes an insert member having a thermoplastic layer attached to a foam layer. The insert member is formed to be inserted within a sandal member. The user heats the thermoplastic layer to a soft state and then presses the gripping members of an athletic shoe into the thermoplastic layer and the foam layer which conform to the gripping members creating recessed portions. The user then allows the thermoplastic layer to cool into a hard state and then inserts the insert member into a sandal member. The user may then insert the athletic shoe into the sandal member with the gripping members fitting within the recessed portions of the thermoplastic layer.

8 Claims, 14 Drawing Sheets

ATHLETIC SHOE PROTECTION SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to shoe protective devices and more specifically it relates to an athletic shoe protection system for effectively protecting the cleats and spikes of athletic shoes while worn by an athlete.

2. Description of the Related Art

Athletic shoes with gripping members (e.g. cleats ands spikes) have been in use for years. The gripping members are typically sharpened metal structures that provide added traction upon ground and track surfaces.

However, if the athlete walks upon a hard surface such as concrete, pavement and the like, the gripping members become damaged. In addition, the gripping members may cause damage to flooring and other surfaces. Also, the gripping members are relatively slippery and unstable when utilized upon a hard surface.

One conventional type of shoe protection device are rubber overshoes, but they are not suitable for usage upon athletic shoes with sharpened gripping members for obvious reasons. U.S. Pat. Nos. 1,340,356 and 3,283,424 provide examples of patented technologies that attempt to solve this problem. However, these products are not designed to fit with various shoe designs and gripping member sizes/patterns/shapes. Hence, there is a need for a product that will conform to various types of athletic shoes.

While these devices may be suitable for the particular purpose to which they address, they are not as suitable for effectively protecting the cleats and spikes of athletic shoes while worn by an athlete. Conventional shoe protection devices are not suitable for usage upon various designs of athletic shoes.

In these respects, the athletic shoe protection system according to the present invention substantially departs from the conventional concepts and designs of the prior art, and in so doing provides an apparatus primarily developed for the purpose of effectively protecting the cleats and spikes of athletic shoes while worn by an athlete.

BRIEF SUMMARY OF THE INVENTION

In view of the foregoing disadvantages inherent in the known types of shoe protective devices now present in the prior art, the present invention provides a new athletic shoe protection system construction wherein the same can be utilized for effectively protecting the cleats and spikes of athletic shoes while worn by an athlete.

The general purpose of the present invention, which will be described subsequently in greater detail, is to provide a new athletic shoe protection system that has many of the advantages of the shoe protective devices mentioned heretofore and many novel features that result in a new athletic shoe protection system which is not anticipated, rendered obvious, suggested, or even implied by any of the prior art shoe protection devices, either alone or in any combination thereof.

To attain this, the present invention generally comprises a thermoplastic layer attached to a foam layer. The insert member is formed to be inserted within a sandal member. The user heats the thermoplastic layer to a soft state and then presses the gripping members of an athletic shoe into the thermoplastic layer and the foam layer which conform to the gripping members creating recessed portions. The user then allows the thermoplastic layer to cool into a hard state and then inserts the insert member into a sandal member. The user may then insert the athletic shoe into the sandal member with the gripping members fitting within the recessed portions of the thermoplastic layer.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide an athletic shoe protection system that will overcome the shortcomings of the prior art devices.

A second object is to provide an athletic shoe protection system for effectively protecting the cleats and spikes of athletic shoes while worn by an athlete.

Another object is to provide an athletic shoe protection system that protect shoe gripping members such as but not limited to cleats and spikes.

A further object is to provide an athletic shoe protection system that extends the life of shoe gripping members.

Another object is to provide an athletic shoe protection system that allows an athlete to retain their athletic shoes on their feet without having to change the same.

An additional object is to provide an athletic shoe protection system that that may be utilized upon various shapes, sizes and designs of shoes.

An additional object is to provide an athletic shoe protection system that may be easily assembled by a consumer.

A further object is to provide an athletic shoe protection system that provides added traction when upon hard surfaces.

A further object is to provide an athletic shoe protection system that may be utilized with respect to various shoe gripping member designs, patterns, shapes and sizes.

Another object is to provide an athletic shoe protection system that allows a universal fit to most athletic shoes.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
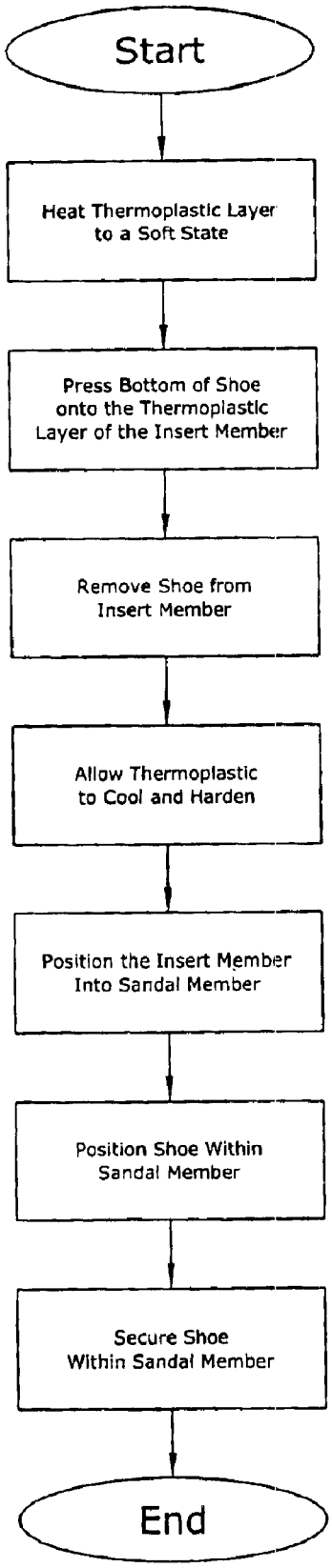
FIG. 1 is a flowchart illustrating the overall operation of the present invention.

Turning now descriptively to the drawings, in which similar reference characters denote similar elements throughout the several views, FIGS. 1 through 12 illustrate an athletic shoe protection system 10, which comprises a thermoplastic layer 30 attached to a foam layer 40. The insert member 20 is formed to be inserted within a sandal member 50. The user heats the thermoplastic layer 30 to a soft state and then presses the gripping members 14 of an athletic shoe 12 into the thermoplastic layer 30 and the foam layer 40 which conform to the gripping members 14 creating recessed portions 32. The user then allows the thermoplastic layer 30 to cool into a hard state and then inserts the insert member 20 into a sandal member 50. The user may then insert the athletic shoe 12 into the sandal member 50 with the gripping members 14 fitting within the recessed portions 32 of the thermoplastic layer 30.

B. Sandal Member

As shown in FIGS. 7 through 10 of the drawings, a sandal member 50 is provided for receiving the insert member 20 and the shoe 12. The sandal member 50 may have various structures, shapes and designs as are commonly utilized within the sandal industry.

Figure 8:
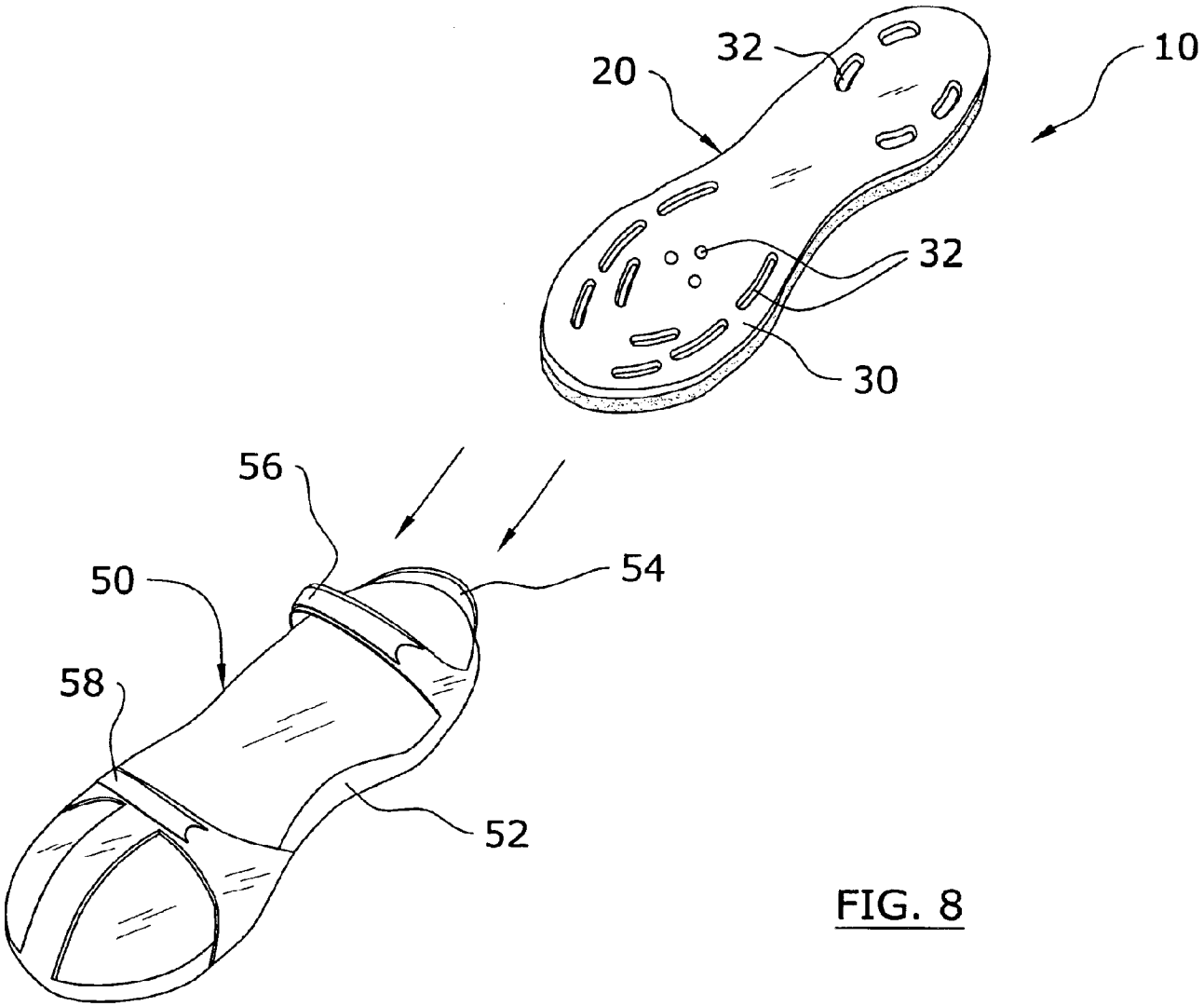
FIG. 8 is an upper perspective view of the insert member being inserted into the sandal member.
Figure 9:
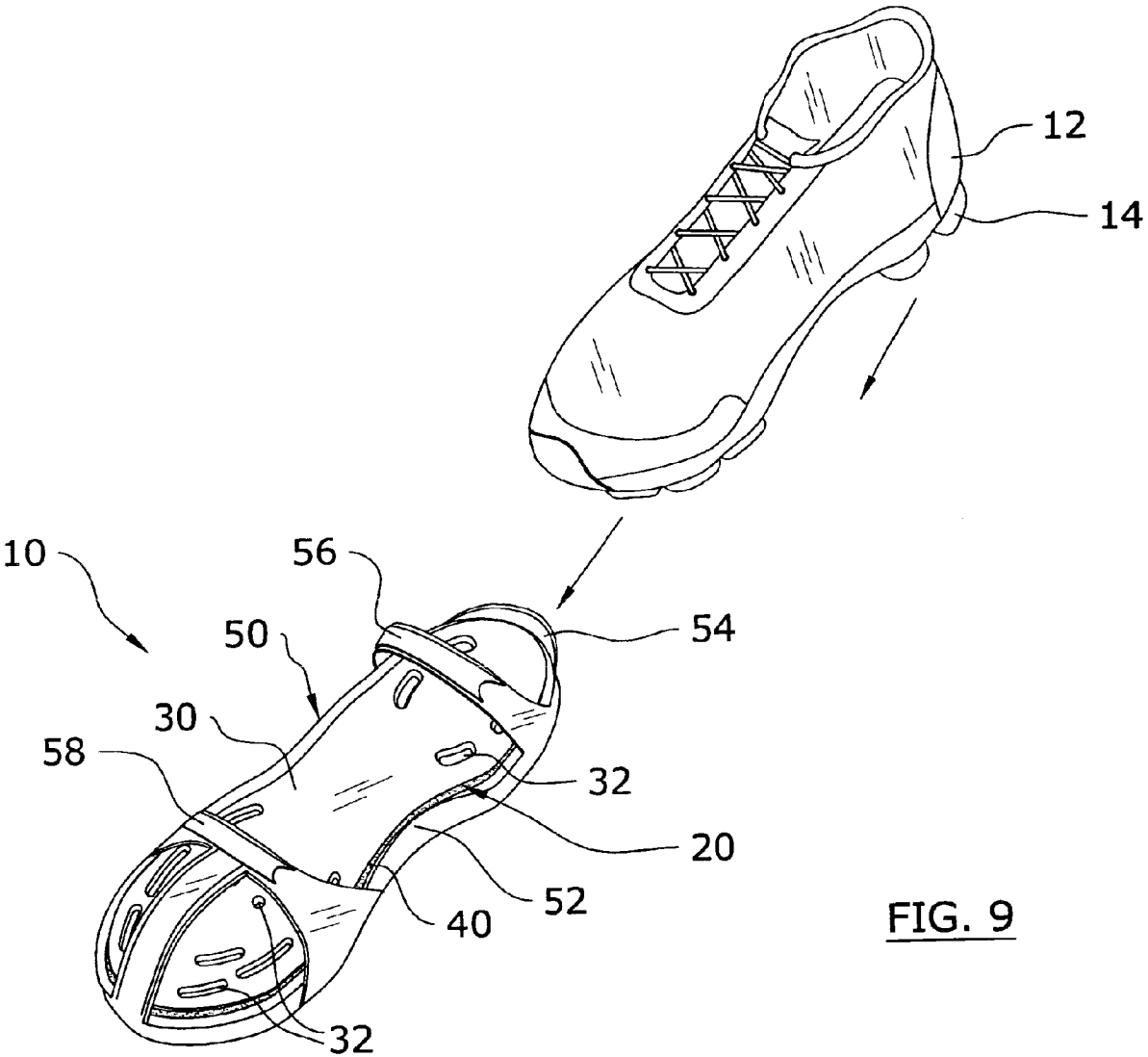
FIG. 9 is an upper perspective view of the shoe being inserted into the sandal member on top of the insert member.

The sandal member 50 includes a resilient sole 52 with a bottom surface for safely and comfortably gripping a surface. The sandal member 50 also preferably includes a rear lip 54 extending upwardly from a rear end of the resilient sole 52 for assisting in retaining the insert member 20 within the sandal member 50 as best shown in FIGS. 8 and 9 of the drawings.

The sandal member 50 has a securing structure for removably receiving and securing the shoe 12. The securing structure is preferably comprised of at least a rear strap 56 and a front strap 58 as shown in FIGS. 7 through 10 of the drawings.

The rear strap 56 and the front strap 58 preferably utilize a fastener such as a buckle, hook and loop fastener, buttons, elastic and the like to secure the shoe 12 within the sandal member 50. It can be appreciated that various other structures may be utilized to secure the shoe 12 within the sandal member 50.

C. Insert Member

Figure 6A:
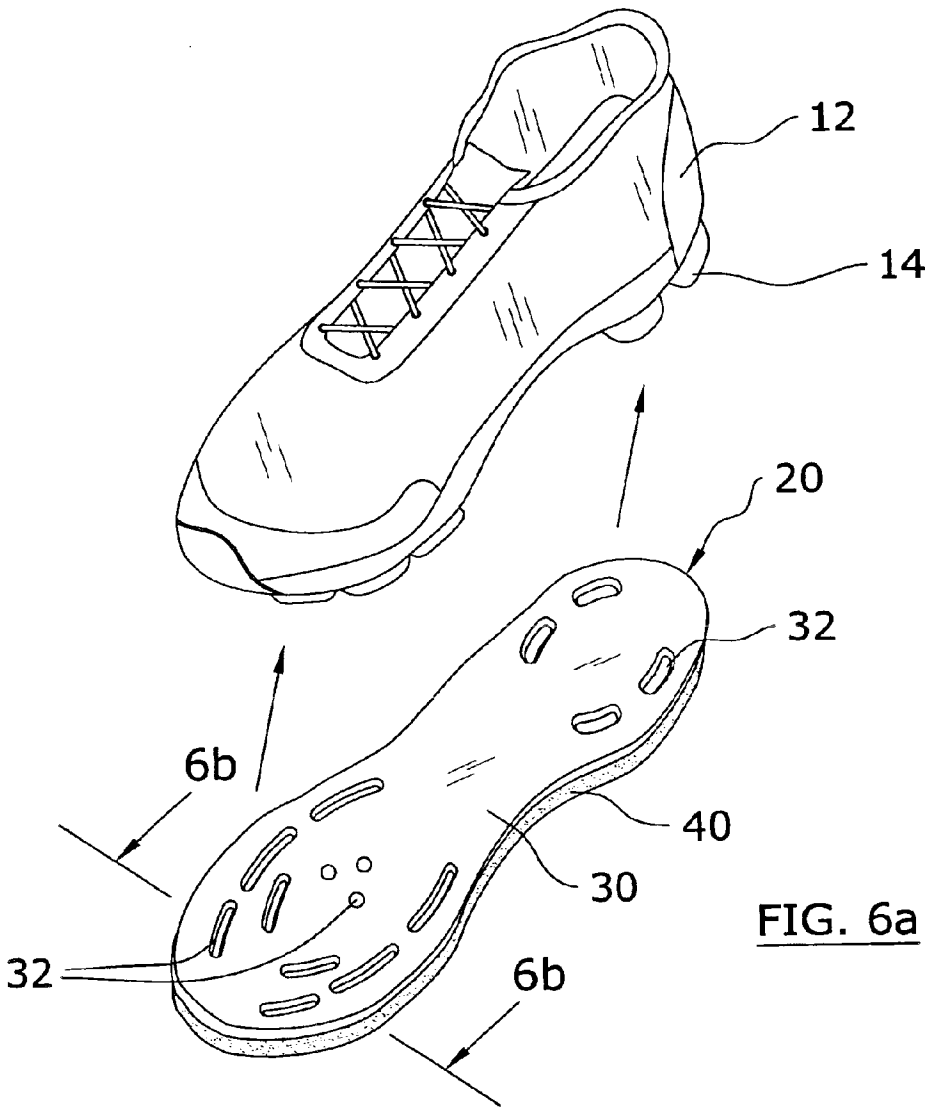
FIG. 6*a* is an upper perspective view of the shoe with gripping member being removed from the thermoplastic layer.
Figure 6B:
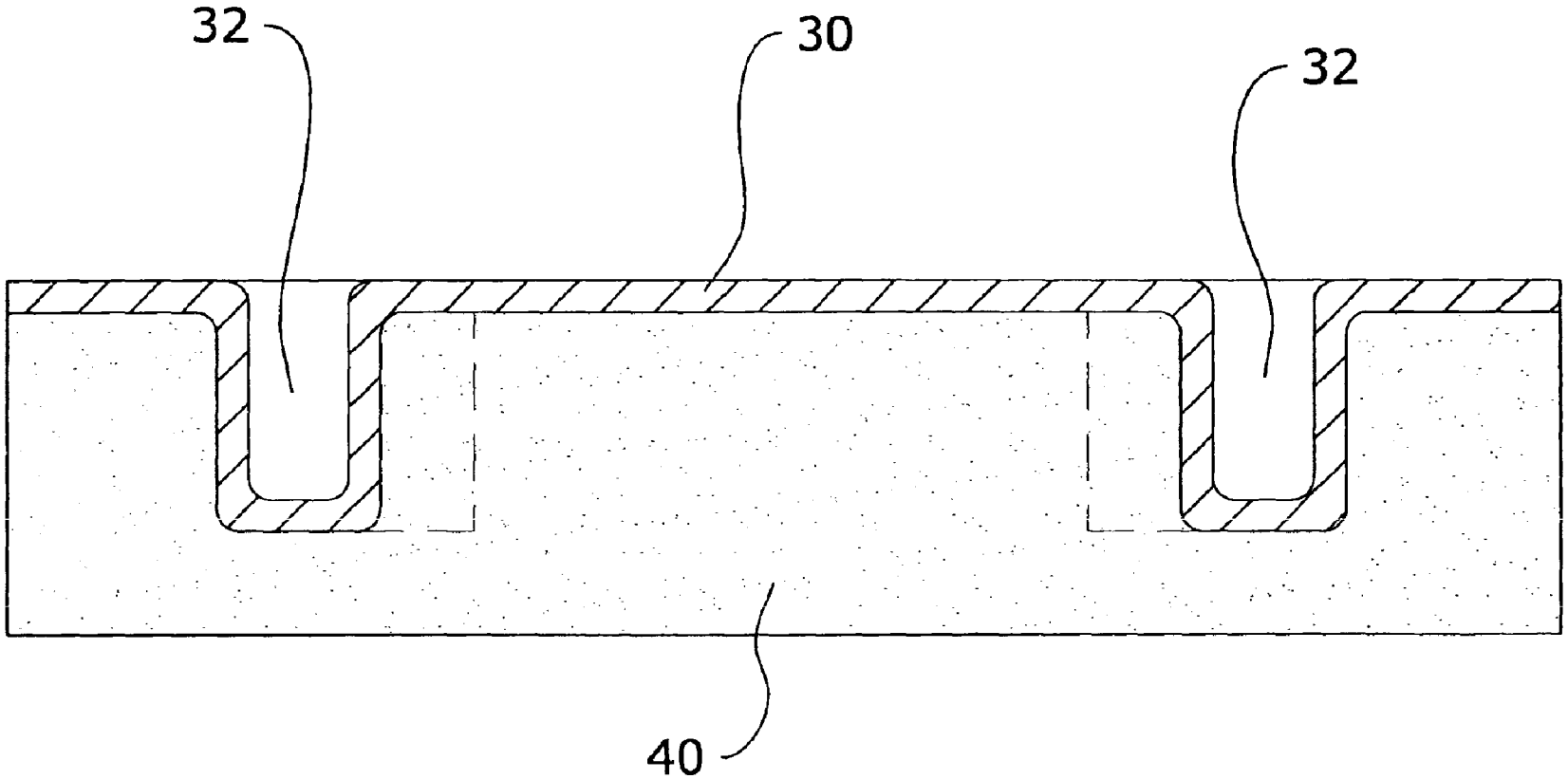
FIG. 6*b* is a cross sectional view taken along line 6*b*—6*b* of FIG. 6*a* illustrating the recessed portions.
Figure 6C:
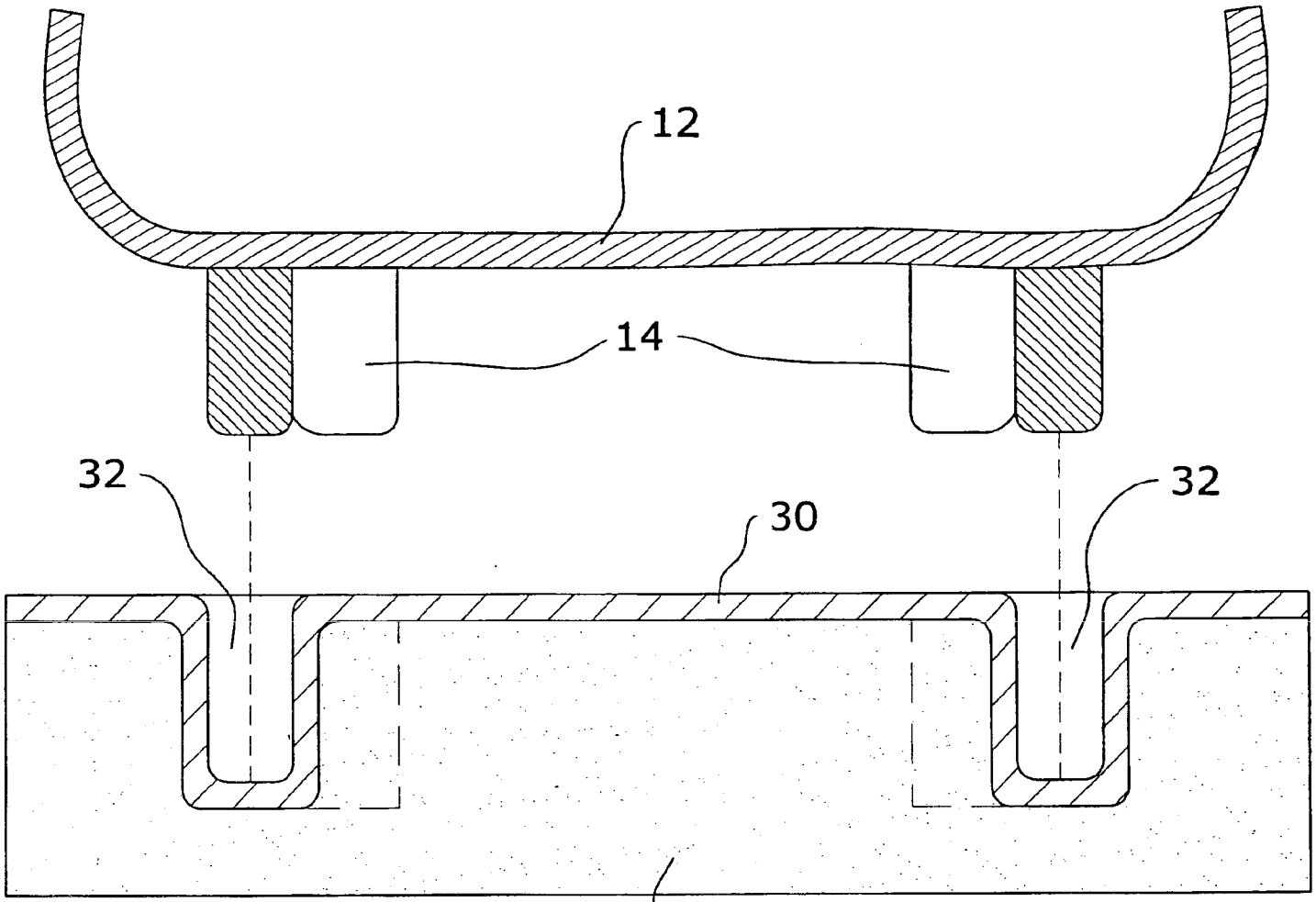
FIG. 6*c* is a cross sectional view illustrating the gripping members positioned within the recessed portions.
Figure 7:
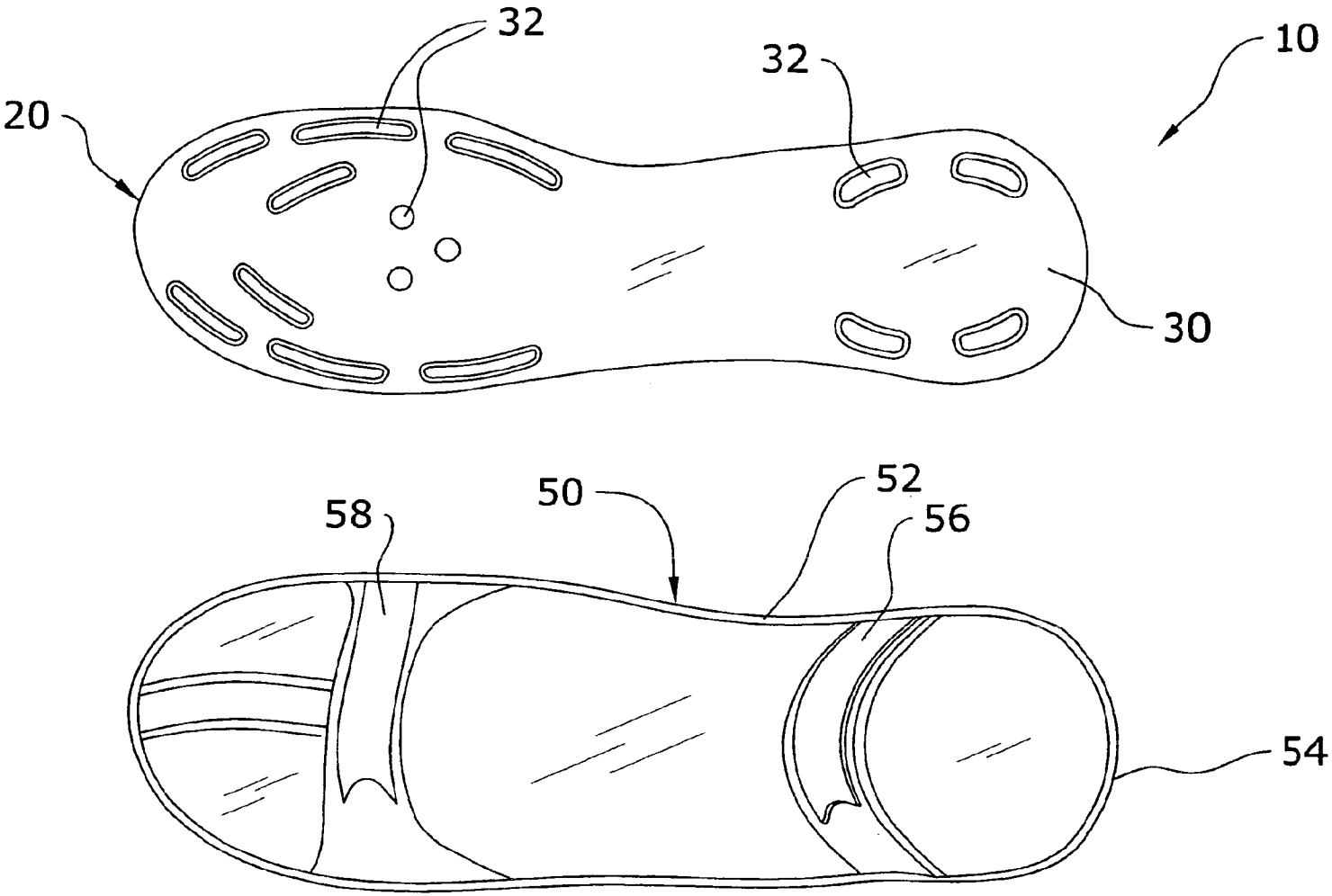
FIG. 7 is a top view of the insert member with the created recessed portions and the sandal member.

An insert member 20 is provided that is positionable within the upper surface of the resilient sole 52 of the sandal member 50 as shown in FIGS. 2 through 9 of the drawings. The insert member 20 is formed to the shape of the sandal member 50 as best shown in FIG. 7 of the drawings. The insert member 20 is formed for receiving the gripping members 14 (e.g. cleats, spikes, etc.) of a shoe 12.

Figure 2:
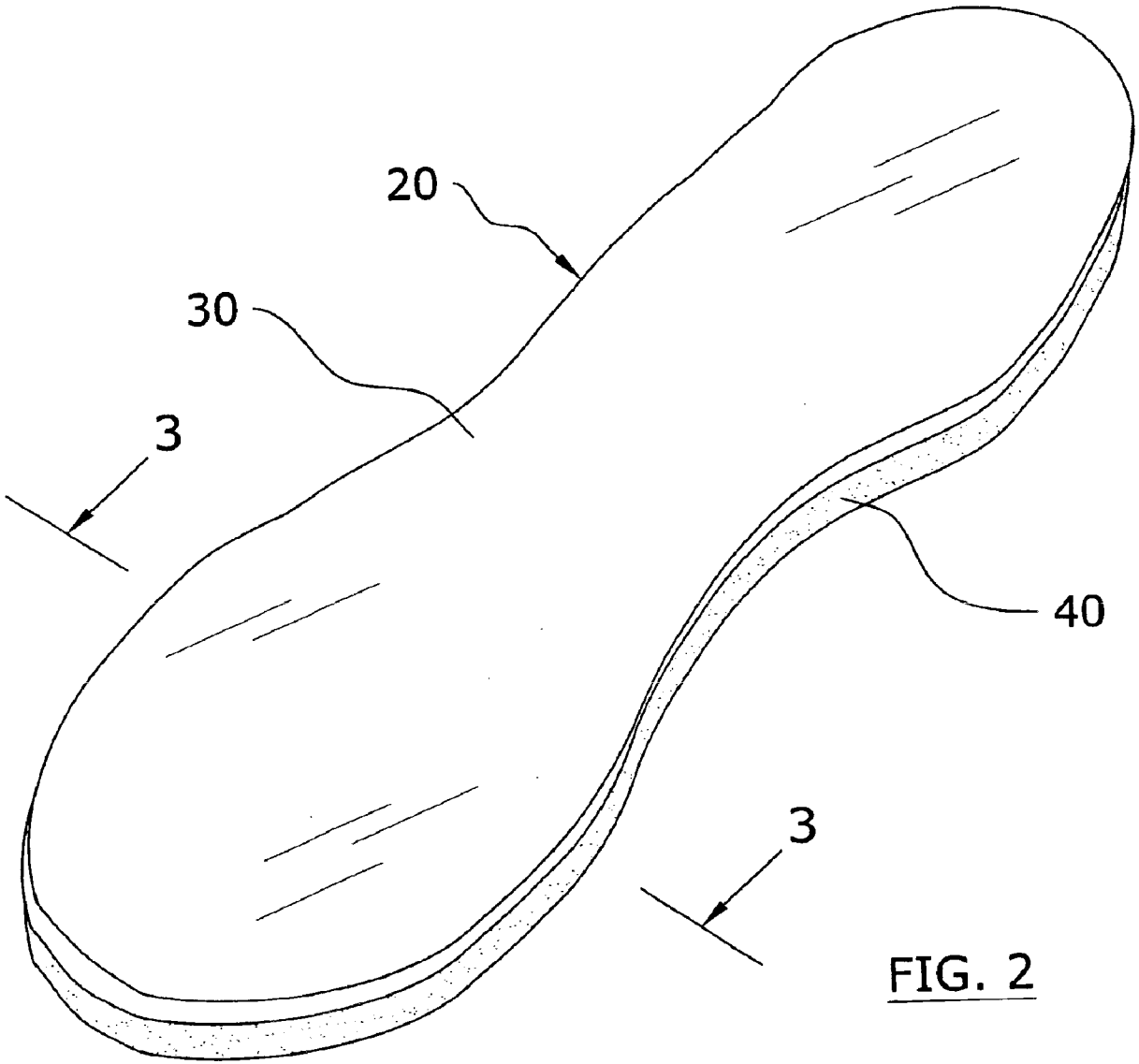
FIG. 2 is an upper perspective view of the insert member.
Figure 3:
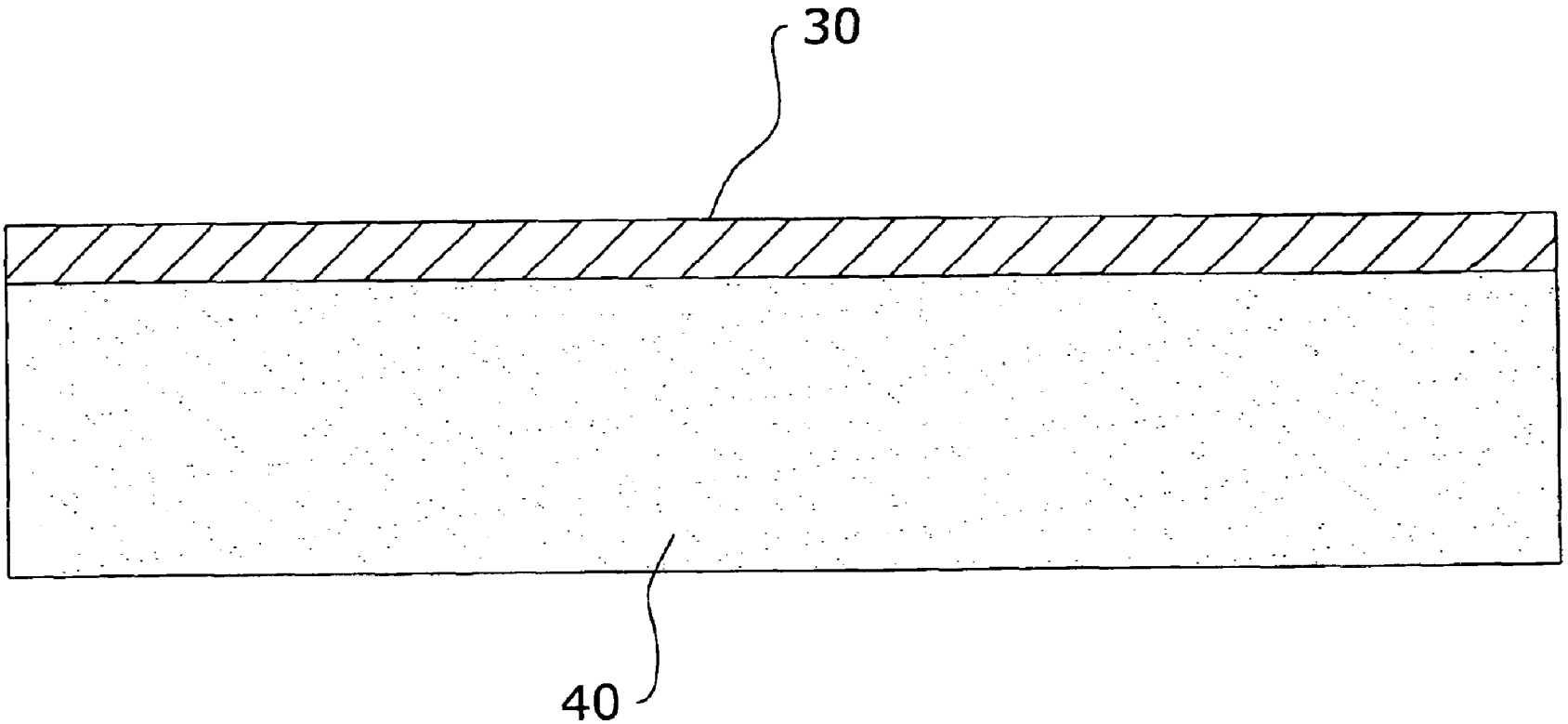
FIG. 3 is a cross sectional view taken along line 3—3 of FIG. 2.

The insert member 20 has a thermoplastic layer 30 attached to a foam layer 40 as best shown in FIGS. 2 and 3 of the drawings. The thermoplastic layer 30 enters a soft state when heated for receiving a plurality of gripping members 14 from a shoe 12 thereby forming recessed portions 32 within the insert member 20. The thermoplastic layer 30 may be comprised of various types of thermoplastic materials that enter a soft state when heated and that enter a hard state when cooled.

The insert member 20 is preferably removably positioned within the sandal member 50 for allowing interchanging of the insert member 20 for various shoes 12. However, the insert member 20 may be temporarily or permanently secured within the sandal member 50. Various attachment structures may be utilized to secure the insert member 20 within the sandal member 50.

The foam layer 40 is preferably comprised of a resilient foam material which may or not be sensitive to heat. The foam layer 40 provides a cushion for the shoe 12 and also provides a structure for receiving the recessed portions 32 formed from the gripping members 14. The foam layer 40 is preferably comprised of a T-foam material which is malleable when heated, however various other types of foam materials may be utilized for the foam layer 40.

D. Operation of Invention

Figure 4:
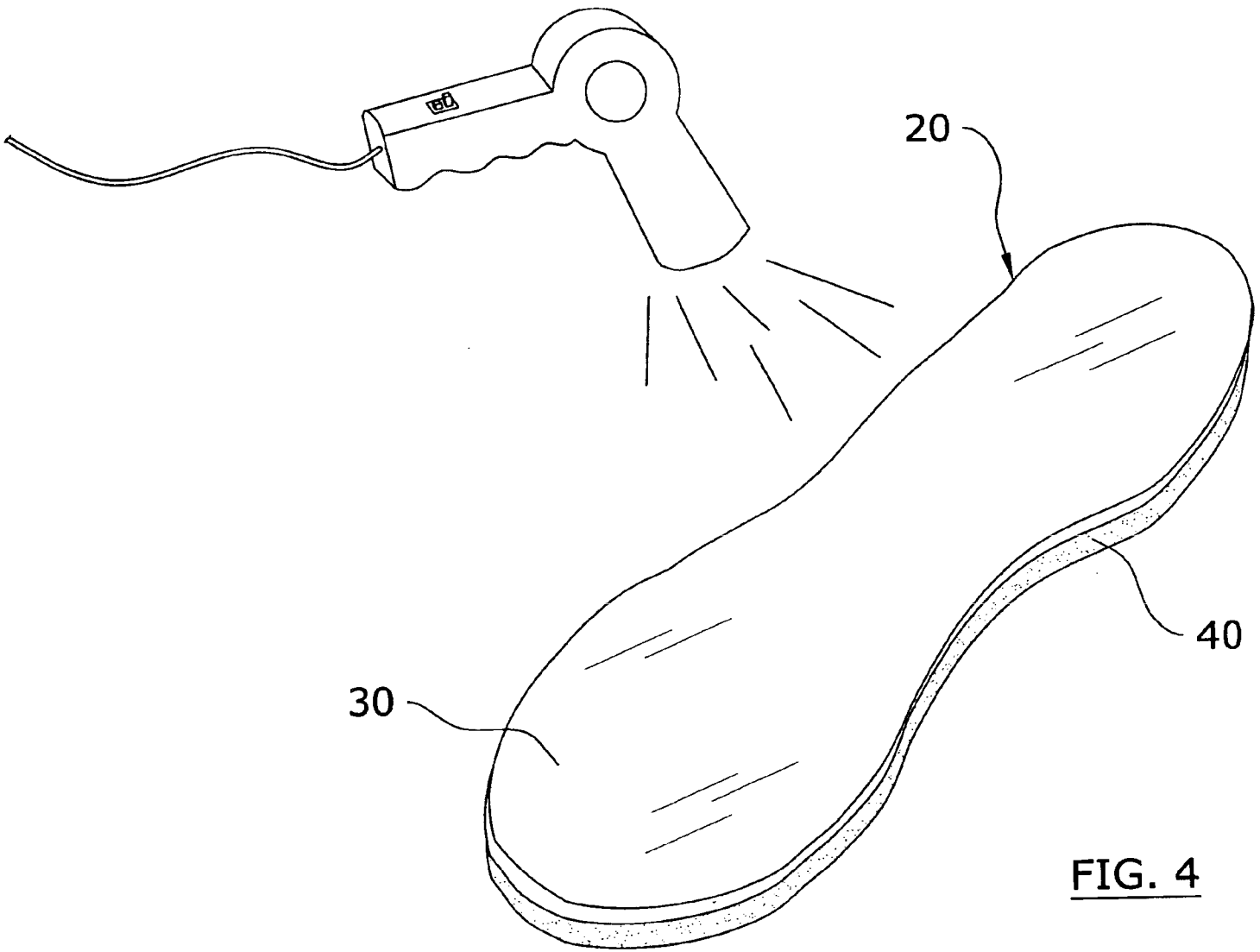
FIG. 4 is an upper perspective view of the insert member with a heater unit applying heat to the thermoplastic layer.
Figure 5:
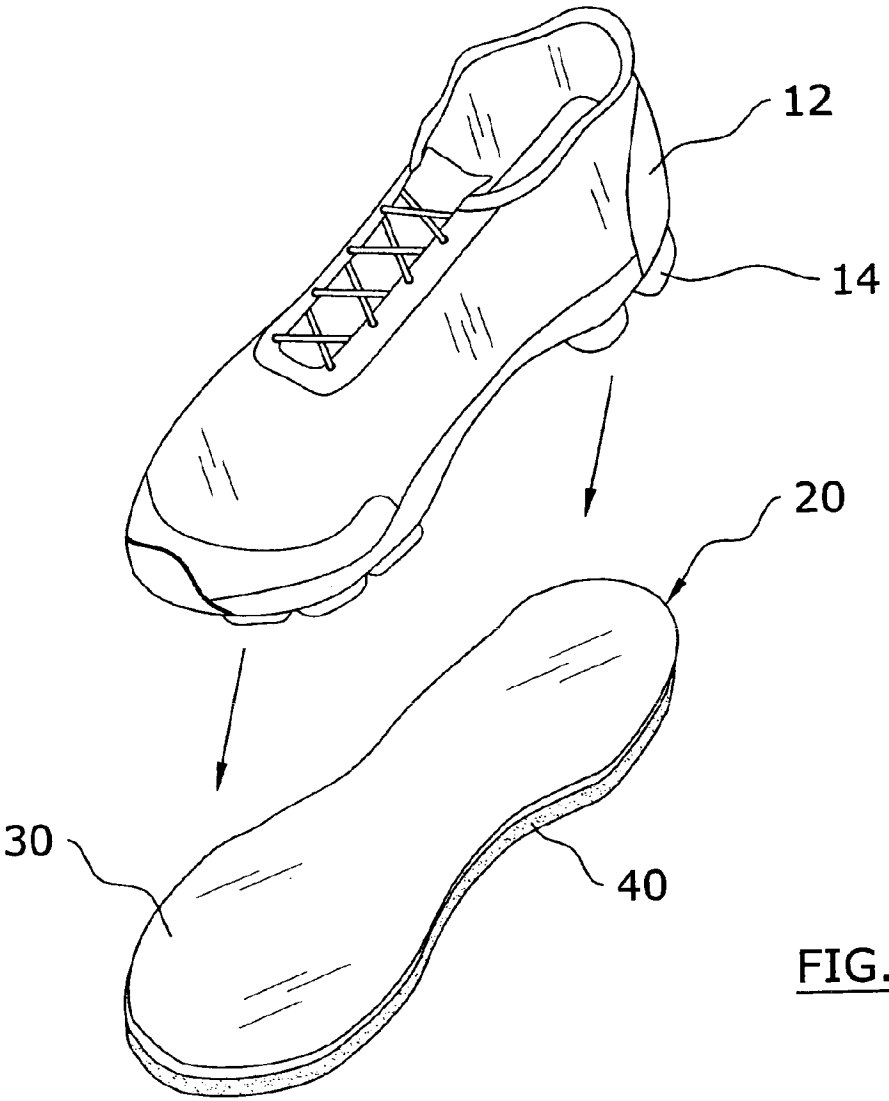
FIG. 5 is an upper perspective view of the shoe with gripping member being applied to the heated thermoplastic layer.

In use, the user first heats the thermoplastic layer 30 of the insert member 20 with a heater unit such as but not limited to a blow dryer as shown in FIGS. 1 and 4 of the drawings. After the thermoplastic layer 30 has entered into a soft state, the user then presses the shoe 12 with the gripping members 14 downwardly and centrally upon the insert member 20 as shown in FIGS. 1 and 5 of the drawings. The user applies a force required to force the gripping members 14 into the thermoplastic layer 30 and into the foam layer 40 thereby creating recessed portions 32.

The user then may leave the shoe 12 upon the insert member 20 until the thermoplastic layer 30 has cooled or remove before fully cooling the insert member 20 as shown in FIG. 6*a* of the drawings. The recessed portions 32 have the shape of the gripping members 14 and extend downwardly a distance corresponding to each of the gripping members 14 as shown in FIGS. 6*a* through 6*c* of the drawings.

Figure 10:
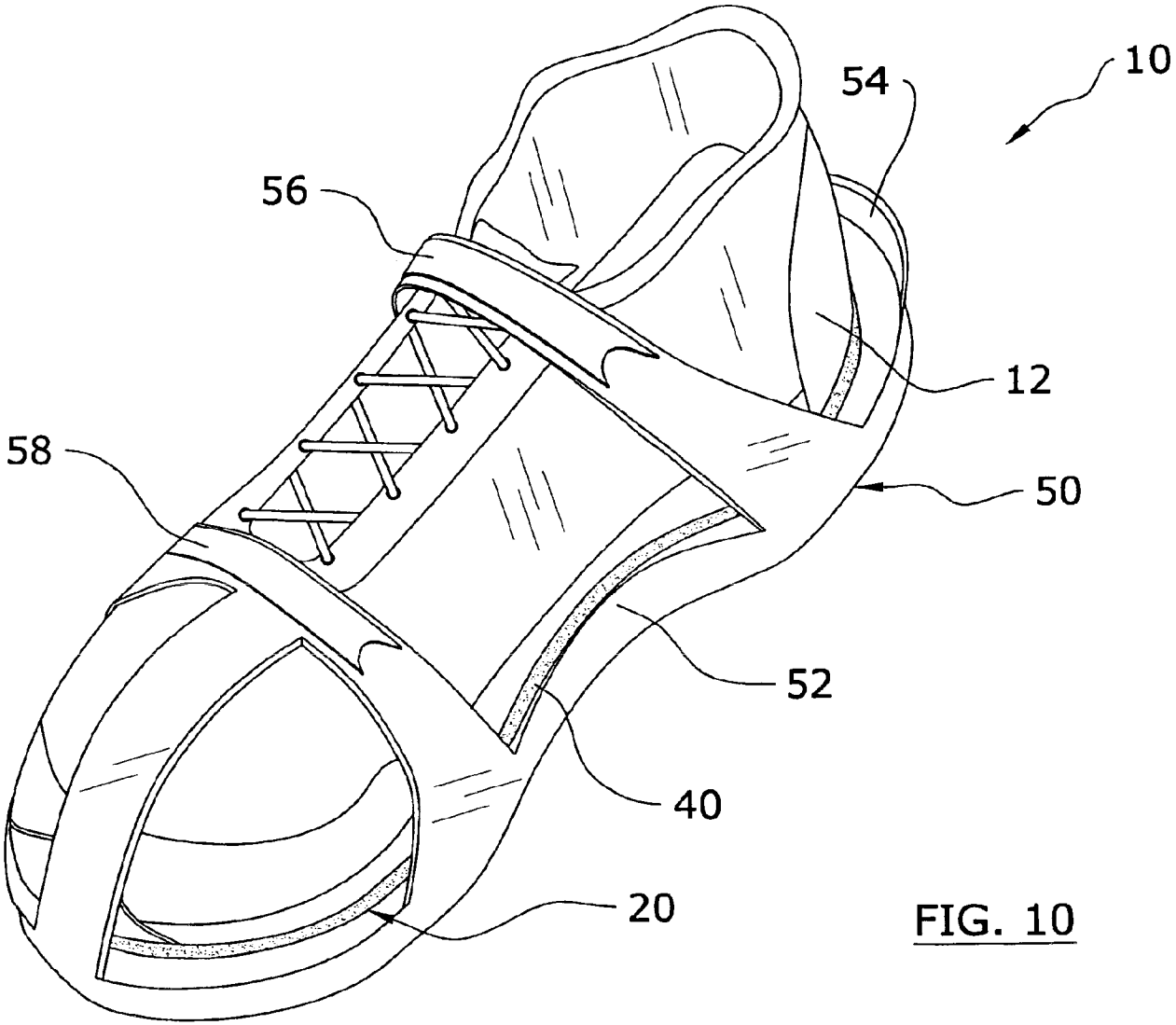
FIG. 10 is an upper perspective view of the shoe inserted into the sandal member on top of the insert member.
Figure 11:
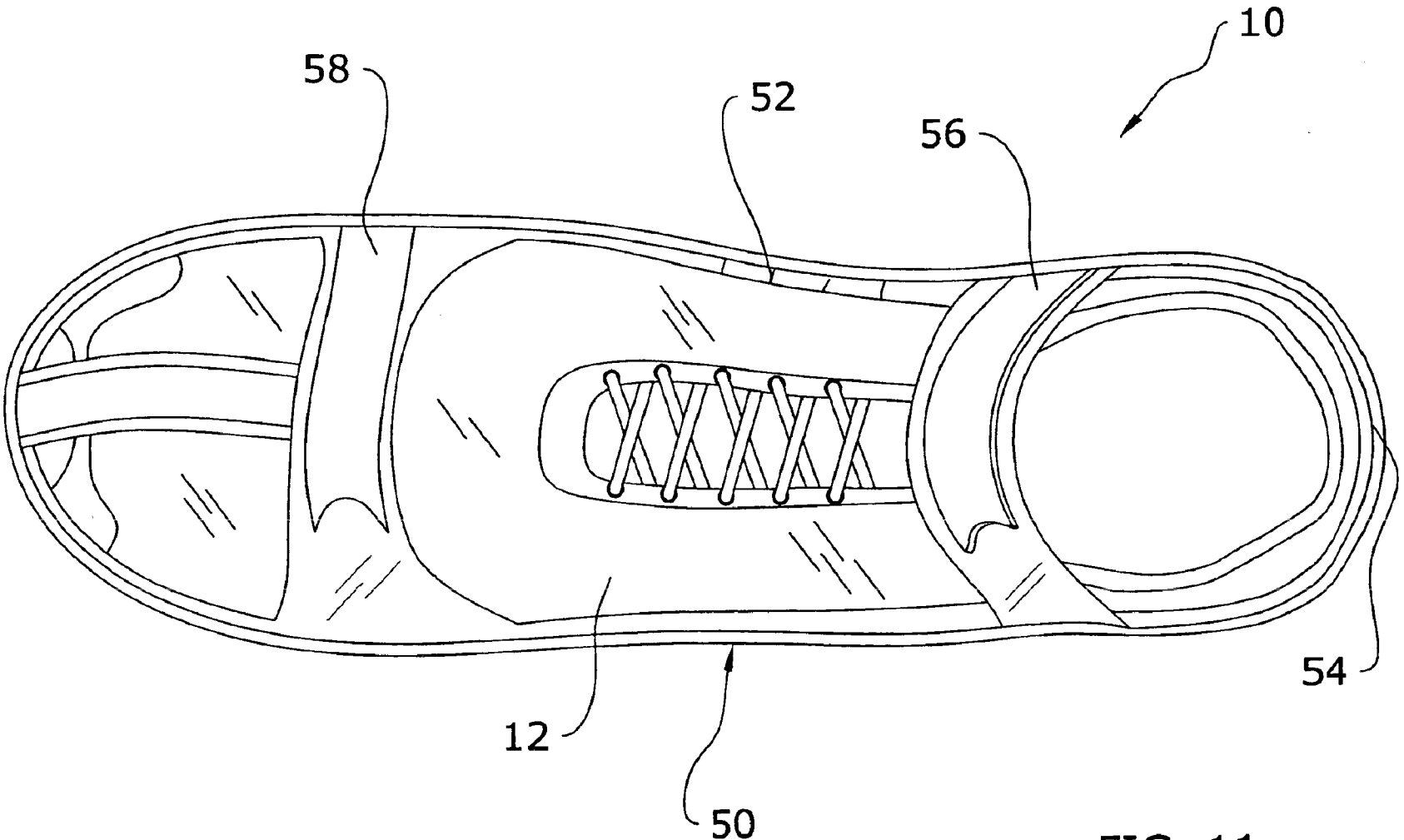
FIG. 11 is a top view of the shoe inserted into the sandal member on top of the insert member.
Figure 12:
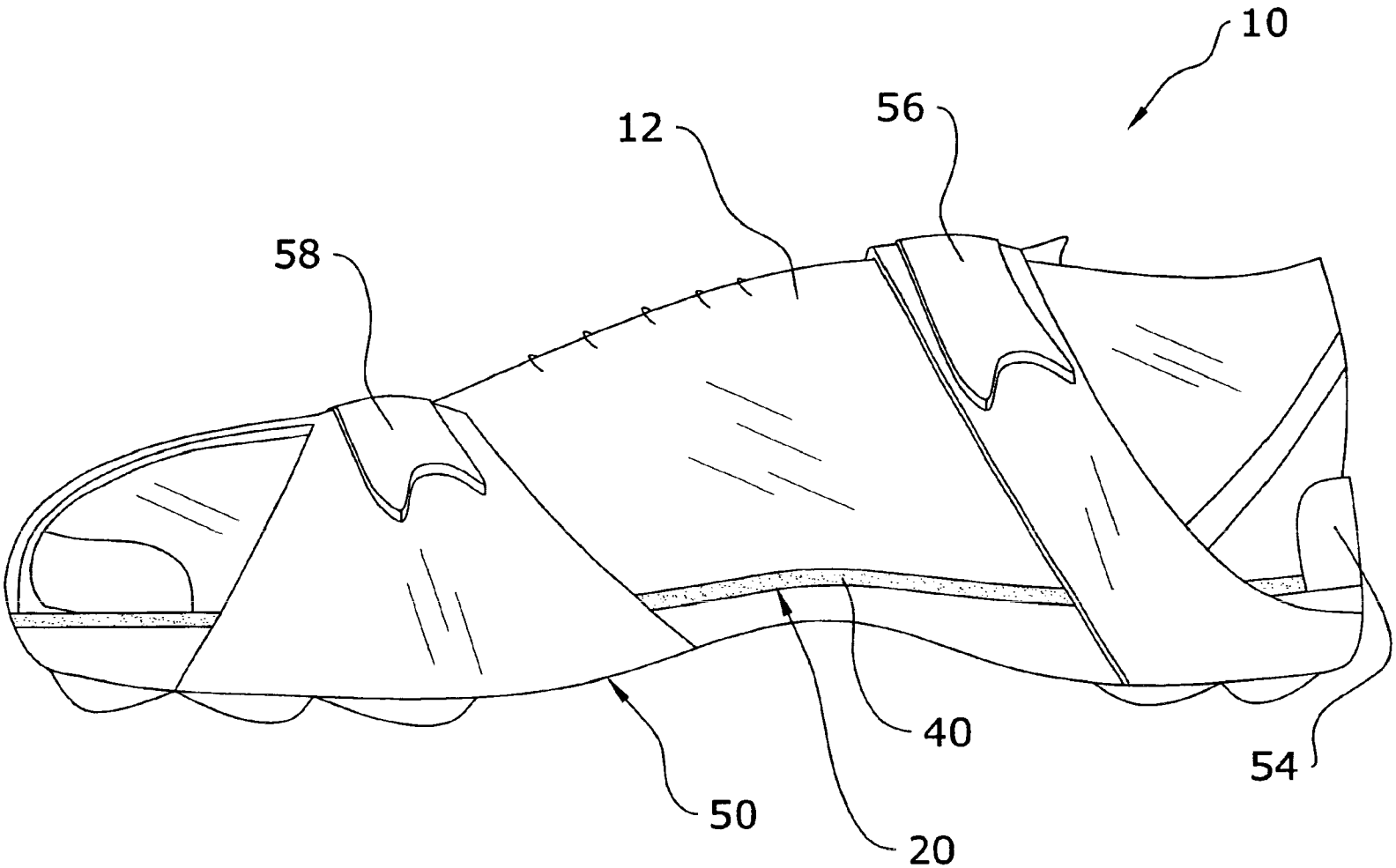
FIG. 12 is a side view of the shoe inserted into the sandal member on top of the insert member.

After the thermoplastic layer 30 has fully hardened (or before), the user then positions the insert member 20 into the sandal member 50 as shown in FIG. 8 of the drawings. After the insert member 20 is properly positioned within the sandal member 50, the user then inserts the shoe 12 into the sandal member 50 on top of the insert member 20, wherein the gripping members 14 of the shoe 12 are received by the recessed portions 32 as shown in FIGS. 9 and 10 of the drawings.

The user then properly secures the front strap 58 and the rear strap 56 of the sandal member 50 thereby retaining the shoe 12 within the sandal member 50 in a secure state. The user is then able to walk or run with the gripping members 14 fully protected from the ground surface.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An athletic shoe protection system, comprising:

a sandal member having a securing structure for receiving a shoe with a plurality of gripping members; and an insert member having a thermoplastic layer attached to a foam layer, wherein said insert member is positionable within said sandal member and said insert member has means for softening when heated to form a plurality of recesses by pressing the gripping members of the of shoe into the thermoplastic layer and foam layer and hardened when cooled.

2. The athletic shoe protection system of claim 1, wherein said sandal member includes a resilient sole.

3. The athletic shoe protection system of claim 2, wherein said sandal member includes a rear lip extending upwardly from a rear end of said resilient sole.

4. The athletic shoe protection system of claim 1, wherein said securing structure is comprised of at least a rear strap and a front strap.

5. The athletic shoe protection system of claim 1, wherein said insert member is removably positioned within said sandal member for allowing interchanging of said insert member for various shoes.

6. The athletic shoe protection system of claim 1, wherein said insert member is secured within said sandal member.

7. The athletic shoe protection system of claim 1, wherein said foam layer is comprised of a resilient foam material.

8. The athletic shoe protection system of claim 1, wherein said foam layer is comprised of a T-foam material.

* * * * *